US012486978B1

(12) United States Patent
Gonzalez

(10) Patent No.: US 12,486,978 B1
(45) Date of Patent: Dec. 2, 2025

(54) FLARE BONNET

(71) Applicant: Victor Gonzalez, Midland, TX (US)

(72) Inventor: Victor Gonzalez, Midland, TX (US)

(73) Assignee: Vorti-Tek International, LLC, Midland, TX (US)

( * ) Notice: Subject to any disclaimer, the term of this patent is extended or adjusted under 35 U.S.C. 154(b) by 357 days.

(21) Appl. No.: 17/559,424

(22) Filed: Dec. 22, 2021

(51) Int. Cl.
*F23G 7/08* (2006.01)
*F23L 1/00* (2006.01)

(52) U.S. Cl.
CPC . *F23G 7/08* (2013.01); *F23L 1/00* (2013.01)

(58) Field of Classification Search
CPC ..... F23L 1/00; F23G 7/08
USPC ..... 431/70, 202, 350–353
See application file for complete search history.

(56) References Cited

U.S. PATENT DOCUMENTS 3,893,810 A * 7/1975 Lientz ..... F23G 7/085 422/111
11,725,813 B2 * 8/2023 Khan ..... F23G 7/08 431/202

* cited by examiner

*Primary Examiner* — Vivek K Shirsat
(74) *Attorney, Agent, or Firm* — Kearney, McWilliams & Davis; Erik J. Osterrieder

(57) ABSTRACT

A flare bonnet for a flare burning combustible fluids. The flare bonnet can comprise a flare for burning a combustible fluid, a bonnet covering a tip of the flare, wherein the bonnet comprises at least one aperture to allow air flow, and a paddle wheel proximate each aperture to increase and direct the air flow. Increasing the air flow at the point of combustion can increase efficacy and thoroughness of combustion of the fluid by providing more oxygen. This can help gas flares to be more environmentally friendly, as well as more efficient. The paddle wheel can help to increase and direct the flow of air toward combustion.

19 Claims, 1 Drawing Sheet

FLARE BONNET

FIELD

The present disclosure generally relates to a fluid flow fitting for combustible fluids. Specifically, a bonnet for a flare stack.

BACKGROUND

Combustible fluids are delivered to an ignition source in many ways. Typical means may include a simple flow of fluid, such as in a gas range, an injection of fluid, such as the fuel injectors of a car, and the like.

While many applications exist for such a fitting, gas flaring is a common method of combusting unwanted or excess gases and/or liquids either as a means of disposal, or as a safety measure, such as to relieve pressure.

Fluid products can be released during normal or unplanned operation in many industrial processes, such as oil-gas extraction, refineries, chemical plants, the coal industry, or landfills.

In flaring operations, combustible gasses can be incompletely, and/or inefficiently combusted. This can lead to environmental pollution and preventable undesired emissions.

In many instances, increasing air flow at the point of combustion can increase efficacy and thoroughness of combustion of the fluid by providing more oxygen. This can help gas flares to be more environmentally friendly, as well as more efficient.

It is desirable, therefore, to increase air flow at the point of combustion of a flare.

The present invention meets this need.

BRIEF DESCRIPTION OF THE DRAWINGS

The detailed description will be better understood in conjunction with the accompanying drawings as follows.

Figure 1:
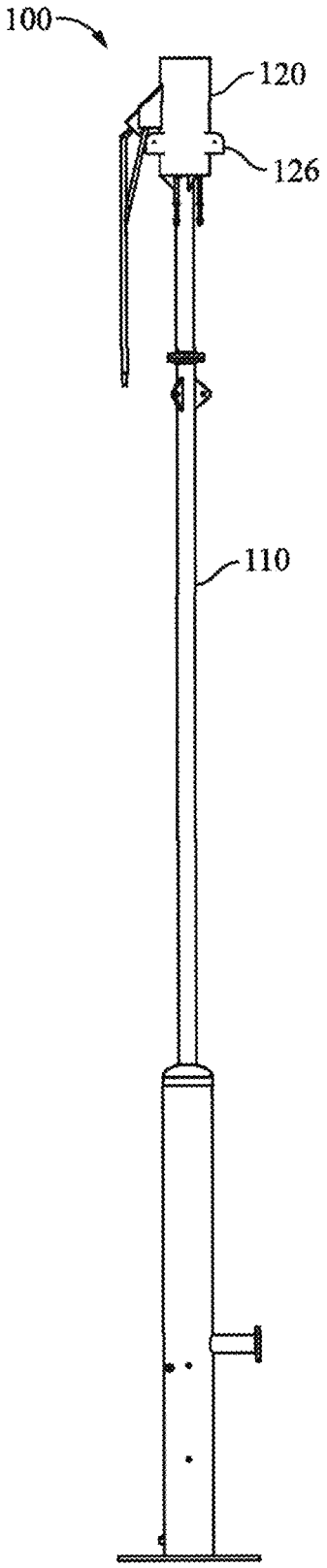
FIG. 1 depicts an embodiment of a flare stack and flare bonnet of the present disclosure.

The embodiments of the present disclosure are detailed below with reference to the listed Figures.

DETAILED DESCRIPTION OF THE EMBODIMENTS

Before explaining the present disclosure in detail, it is to be understood that the disclosure is not limited to the specifics of particular embodiments as described and that it can be practiced, constructed, or carried out in various ways.

While embodiments of the disclosure have been shown and described, modifications thereof can be made by one skilled in the art without departing from the spirit and teachings of the disclosure. The embodiments described herein are exemplary only, and are not intended to be limiting.

Specific structural and functional details disclosed herein are not to be interpreted as limiting, but merely as a basis of the claims and as a representative basis for teaching persons having ordinary skill in the art to variously employ the present embodiments. Many variations and modifications of embodiments disclosed herein are possible and are within the scope of the present disclosure.

Where numerical ranges or limitations are expressly stated, such express ranges or limitations should be understood to include iterative ranges or limitations of like magnitude falling within the expressly stated ranges or limitations.

The use of the word "a" or "an" when used in conjunction with the term "comprising" in the claims and/or the specification may mean "one," but it is also consistent with the meaning of "one or more," "at least one," and "one or more than one."

The word "about" means plus or minus 5% of the stated number.

The use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, and the like.

When methods are disclosed or discussed, the order of the steps is not intended to be limiting, but merely exemplary unless otherwise stated.

Accordingly, the scope of protection is not limited by the description herein, but is only limited by the claims which follow, encompassing all equivalents of the subject matter of the claims. Each and every claim is hereby incorporated into the specification as an embodiment of the present disclosure. Thus, the claims are a further description and are an addition to the embodiments of the present disclosure.

The inclusion or discussion of a reference is not an admission that it is prior art to the present disclosure, especially any reference that may have a publication date after the priority date of this application. The disclosures of all patents, patent applications, and publications cited herein are hereby incorporated by reference, to the extent they provide background knowledge; or exemplary, procedural or other details supplementary to those set forth herein.

The embodiments of the present disclosure generally relate to a fluid flow fitting for combustible fluids. A fluid can mean a gas or a liquid for the purposes of this disclosure.

The flare bonnet can comprise a flare for burning a combustible fluid, a bonnet covering a tip of the flare, wherein the bonnet comprises at least one aperture to allow air flow, and a paddle wheel proximate each aperture to increase and direct air flow.

The flare can be any flare known to persons having ordinary skill in the art. The specific design and/operative mechanism of the flare is not relevant, rather the novelty of the present disclosure lies in making the combustion of the flare more efficient.

For purposes of this disclosure, a flare shall mean any device intended to deliver fluid for combustion. For example, this can be an industrial flare used at a chemical plant or refinery, a fuel injector in a vehicle, a burner on a range, and the like.

The bonnet can envelop the area at the tip of the flare where combustion occurs. The bonnet can help to direct the flame upward, as well as shield the flare tip from gusts of wind or flying debris which can affect or extinguish a flame.

The bonnet can have one or more apertures in the side of the bonnet to allow for air to flow toward the flare tip. The apertures can be placed at selective heights relative to the flare tip in order to most effectively direct air toward the region of combustion. In embodiments, the apertures can be at different relative heights to create a desired flow direction.

In embodiments, the bonnet can also have an internal fin proximate the aperture to direct air toward a desired location within the bonnet. The fin can be helically curved with respect to the direction of air flow. Alternate fin shapes can be implemented by persons having ordinary skill in the art as desired.

In embodiments, the bonnet can also have an external fin proximate the aperture to draw air toward the bonnet and allow for air to flow through the aperture. The fin can be helically curved with respect to the direction of air flow. Alternate fin shapes can be implemented by persons having ordinary skill in the art as desired.

A paddle wheel can be located proximate each aperture to help direct and increase fluid flow toward the region of combustion within the bonnet. In embodiments, the paddles of the paddle wheel can be curved or otherwise shaped to achieve a desired flow profile of air.

The paddle wheel can be turned based upon the flow of fluid within the bonnet. As hot air rises within the bonnet, the flow of air can turn the paddle wheel. The motion of the paddle wheel can act to create desired air flows within the bonnet and improve combustion.

A motor can be in mechanical communication with each paddle wheel or, In embodiments, multiple paddle wheels. The motor can be used to drive the paddle wheel, and therefore increase the flow of air toward region of combustion within the bonnet. In embodiments, various paddle wheels can be driven at various speeds as desired by persons having ordinary skill in the art.

In embodiments, the control of the paddle wheels can be tied to a supervisory control and data acquisition (SCADA) system, distributed control system, or any other control system known to persons having ordinary skill in the art.

A shield can be placed proximate the paddle wheel to protect the paddle wheel from gusts of wind or debris.

In embodiments, a sensor for measuring temperature, volatile organic chemical content, or pressure can be placed within the bonnet. This can aid in environmental compliance, or flare health monitoring. Various other sensors as known to persons having ordinary skill in the art can be utilized as desired for specific applications. Any known sensor can be implemented.

Turning now to the Figures, FIG. 1 depicts an embodiment of a flare stack and flare bonnet of the present disclosure.

Shown here is flare 100 with pipe 110 and bonnet 120. Shield 126 protecting the paddle wheel (not shown) can also be seen here.

Figure 2:
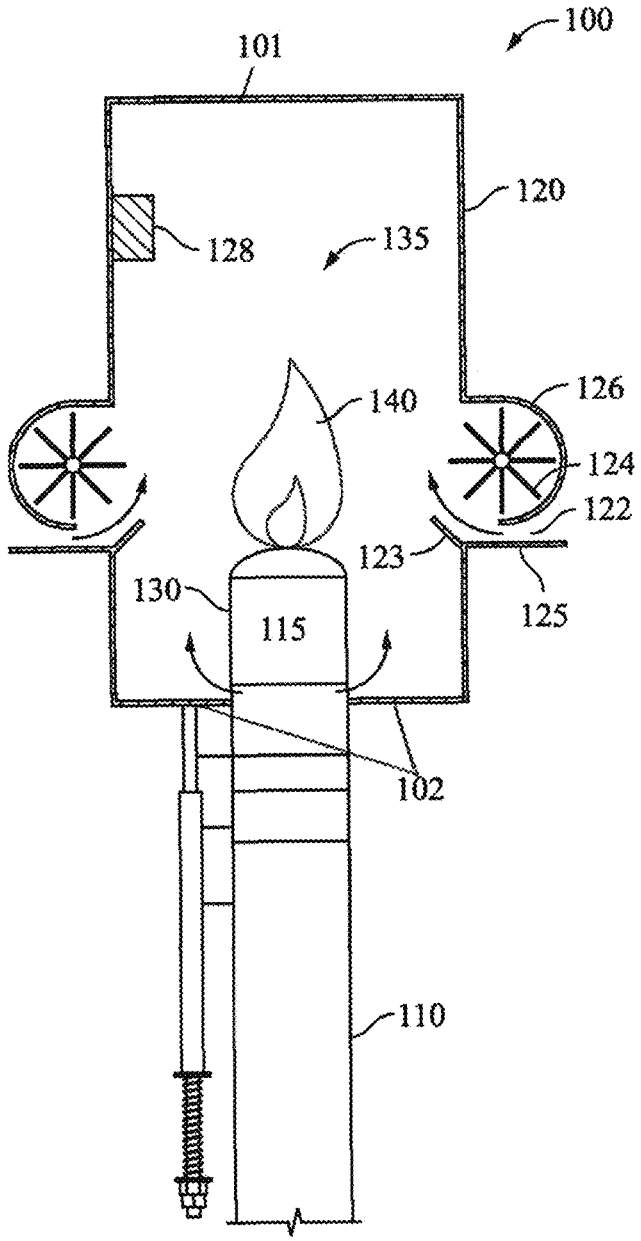
FIG. 2 depicts the flare stack and flare bonnet of FIG. 1 with a cut view of the bonnet.

FIG. 2 depicts the flare stack and flare bonnet of FIG. 1 with a cut view of the bonnet.

Bonnet 120 is shown with aperture 122 and paddle wheel 124. Shield 126 protects the paddle wheel 124 from gusts of wind or flying debris. The shield 126 can also act in concert with the paddle wheel 124 to direct the flow of air. In embodiments, a motor (not shown) can drive the paddle wheel 124. In embodiments wherein multiple paddle wheels are utilized, persons having ordinary skill in the art can drive the paddle wheels at varying speeds as desired.

Bonnet 120 may include a top 101 and a bottom 102 comprising at least a first bottom portion and a second bottom portion, wherein a pipe 110 or any flare source, may extend through a space located between the first bottom portion and a second bottom portion. The bonnet includes an interior 135 located within the bonnet 120, and, consequently, that outside the bonnet 120 is the exterior.

A combustion region 140 within the bonnet where fluids are combusted is shown here. Combustible fluid can be transported via pipe 110 and exit the flare tip 130 into the combustion region 140.

Aperture 122 can be at a desired height with respect to the combustion region 140, which is directly above flare tip 130.

Internal fin 123 and external fin 125 can be used to help direct the flow of air as desired by persons having ordinary skill in the art.

A sensor 128 for measuring temperature, volatile organic chemical content, or pressure can be placed within the bonnet. This can aid in environmental compliance, or flare health monitoring. Various other sensors as known to persons having ordinary skill in the art can be utilized as desired for specific applications. Any known sensor can be implemented.

While the present disclosure emphasizes the embodiments, it should be understood that within the scope of the appended claims, the invention might be practiced other than as specifically described herein.

What is claimed is:

1. A flare bonnet comprising:

a bonnet having an interior and an exterior, wherein the bonnet is capable of enveloping a flare tip within the interior;

at least two paddle wheels, wherein each of the at least two paddle wheels is located within the interior and proximate to opposing surfaces of the bonnet;

at least two apertures, wherein each of the at least two apertures is located below a different one of the at least two paddle wheels;

at least two external fins, wherein each of the at least two external fins extends outward towards the exterior; and at least two internal fins, wherein each of the at least two internal fins extends inward towards the interior.

2. The flare bonnet of claim 1 further comprising at least one sensor.

3. The flare bonnet of claim 1 further comprising a shield at least partially surrounding at least one of the at least two paddle wheels.

4. The flare bonnet of claim 1 further comprising at least two shields, wherein each of the at least two shield at least partially surround a different one of the at least two paddle wheels.

5. The flare bonnet of claim 1, wherein a bottom of the flare bonnet comprises a first bottom portion and a second bottom portion, wherein a space between the first bottom portion and a second bottom portion is capable of fitting at least a bullet of a flare source therethrough, wherein the bottom of the flare bonnet is located below the bullet.

6. The flare bonnet of claim 1, wherein at least one of the at least two apertures is located at a different height of the flare bonnet than at least another one of the at least two apertures.

7. The flare bonnet of claim 1, wherein each of the at least two apertures comprises a space adapted to permit airflow into and out of the bonnet.

8. The flare bonnet of claim 1, wherein at least one of the at least two exterior fins is flat.

9. The flare bonnet of claim 1, wherein at least one of the at least two exterior fins is not flat.

10. The flare bonnet of claim 1, wherein at least one of the at least two exterior fins is about parallel to a ground under which the flare is installed.

11. The flare bonnet of claim 1, wherein at least one of the at least two interior fins is flat.

12. The flare bonnet of claim 1, wherein at least one of the at least two interior fins is not flat.

13. The flare bonnet of claim 1, wherein at least one of the at least two interior fins is angled towards a top of the bonnet.

14. The flare bonnet of claim 1, wherein each of the at least two paddle wheels comprises multiple paddles.

15. The flare bonnet of claim 14, wherein at least one of the multiple paddles comprises a flat paddle.

16. The flare bonnet of claim 14, wherein at least one of the multiple paddles comprises a non-flat paddle.

17. The flare bonnet of claim 1, wherein the at least two apertures comprise at least four apertures.

18. The flare bonnet of claim 1, further comprising at least one motor in communication with at least one of the at least two paddle wheels.

19. The flare bonnet of claim 1, further comprising a supervisory control and data acquisition system, distributed control system, and/or other control system in communication with at least one of the at least two paddle wheels.

* * * * *